United States Patent [19]

Stevens, Jr.

[11] Patent Number: 5,010,593

[45] Date of Patent: Apr. 30, 1991

[54] DECORATIVE NECKTIE KNOT COVER

[76] Inventor: Carl T. Stevens, Jr., 7411 E. Montecito Dr., Tucson, Ariz. 85710

[21] Appl. No.: 571,290

[22] Filed: Aug. 23, 1990

Related U.S. Application Data

[63] Continuation-in-part of Ser. No. 422,238, Oct. 16, 1989.

[51] Int. Cl.[5] ..... A41D 25/02; A41D 25/14

[52] U.S. Cl. ..... 2/152 R; 2/46; 2/148

[58] Field of Search ..... 2/152 R, 145 R, 148, 2/149, 144, 150, 153

[56] References Cited

U.S. PATENT DOCUMENTS

| | | | |
|---|---|---|---|
| 2,316,002 | 4/1943 | Koivisto | 2/153 |
| 2,915,757 | 12/1959 | Sofio, Sr. | 2/46 |
| 3,030,631 | 4/1962 | Tobias | 2/150 |
| 4,875,239 | 10/1989 | Patterson, Jr. | 2/145 X |

FOREIGN PATENT DOCUMENTS

| | | | |
|---|---|---|---|
| 1042307 | 9/1951 | France | 2/152 R |

*Primary Examiner*—Daniel M. Yasich

*Attorney, Agent, or Firm*—J. Michael McClanahan

[57] ABSTRACT

A decorative necktie knot cover is disclosed adapted to be easily placed encompassing a necktie knot and removal therefrom, the decorative cover having a generally triangularly shaped front face with side panels on two of the three sides, the side panels having attached protruding tabs, and a top panel and rear panel; the front side, side panels, top panel, and rear panel folded to form a cavity receiving the necktie knot. Attached to the protruding tabs and to the rear panel are fastening means, the rear panel fastening means adapted to receive the protruding tabs fastening means to secure and define the cavity. In an alternate embodiment, the fastening means are attached only to the protruding tabs in order that they connect with each other behind the rear panel. The top panel attached to the top of the triangular face is so shaped to allow an opening on opposite sides to receive the necktie as it surrounds the person's neck. A single bottom opening at the bottom of the front face permits the tie to emerge from the decorative cover. The necktie knot cover is secured about the knot until removal is desired.

18 Claims, 2 Drawing Sheets

DECORATIVE NECKTIE KNOT COVER

Thus application is a continuation-in-part of patent application Ser. No. 07/422,238, filed Oct. 16, 1989.

BACKGROUND OF THE INVENTION

1. Field of the Invention

The field of the invention is covers for neckties worn by a person about their neck.

2. Description of the Related Art

In the field of the invention, there have been a number of different pieces of apparatus designed to either cover a person's necktie knot or to provide a mechanism within which to pass a person's tie such that a knot is avoided, yet the mechanism takes an appearance that generally is in the triangular shape of a necktie knot.

The inventor is aware of other similar decorative necktie knot protectors and other assorted devices which secure a necktie, but do not encompass a knot, such as those shown in the U.S. Pats. to Peake, U.S. Pat. No. 2,714,719; Koivisto, U.S. Pat. No. 2,316,002; Chapel, U.S. Pat. No. 2,170,707; and Bellon, U.S. Pat. No. 3,263,237. Peake provides a necktie knot protector which has a triangular shaped front face where panels attached to each of the three sides of the triangle cup around to form a volume with two openings at the top and one opening at the bottom. Peake, however, requires that the tie be threaded through the opening if the device is made from rigid metal or, if made from a pliable metal or plastic, the device then does not secure the necktie knot adequately since the flexibility sought in the plastic or metal to easily encompass the knot also provides flexibility for the protector to be inadvertently knocked off the knot. Koivisto provides a necktie knot protector similarly to Peake wherein panels attached to the sides of the triangle are also cupped around to encompass the knot and also provide the three openings, however, by the very shape of the three panels, the openings are not well defined. Consequently, Koivisto suffers from the same shortcomings as does Peake in that if the device is made from durable metal, the wearer has difficulty inserting the knot into the volume formed immediately behind the front face, or if the knot protector is made from a flexible metal or plastic, the flexibility also provides opportunity for the device to inadvertently come off.

The devices shown by Chapel and Bellon receive each end of the necktie at one or more top openings and then pass the necktie out the bottom opening without tieing a knot. In this respect, the devices function more like slip rings on the necktie.

In addition, there have been necktie knot fasteners which incorporate a mechanical mechanism of sorts, such as those shown by the patents to Hellenberg, U.S. Pat. No. 384,036 and Tsang, U.S. Pat. No. 3,745,614. Hellenberg's device utilizes a spring-biased triangular-shaped necktie fastener which has a backside adapted to fully encompass the tie (but not the knot) after it has been placed between the front and back side, the back side folding toward the front to surround the tie, the folding mechanism being spring loaded to hold the back side in place. Tsang has a rather complicated device employing a spring-biased hinge attached to the rear side of the necktie covering device with a protruding fastener type system located centrally to both the front triangular portion and the rear panel. Obviously, Tsang's device allows the necktie to pass through but not anticipate a knot being tied in the tie inasmuch as Tsang's construction does not allow or permit a knot inasmuch as the fastening mechanism would pass through the middle of the knot. In another alternate embodiment of Tsang, a ring interiorly to the volume formed by the front and back panels of the device receives each end of the necktie to align the ends.

All of the prior art known to the inventor of similar devices as illustrated above suffer from shortcomings that placement and removal of the necktie knot cover create one of two problems. First, if the cover is easy to place on the necktie knot, such as illustrated by the Koivisto device, those qualities which render it easy to place over the knot also render it easy to fall off unintentionally, thus defeating the purpose of providing a decorative cover. Secondly, if the device is well secured on the necktie, such as the device shown by Tsang, usually the device does not cover a necktie knot, but is a substitute for the knot and requires threading of the necktie through the device in a special manner which requires a great deal of time and careful attention.

It is apparent therefore that it would be useful to provide a decorative necktie knot cover which is, firstly, easy to place over a person's necktie knot and to be removed, and secondly, is well secured over the knot and not likely to be inadvertently falling off.

Accordingly, there is an obvious advantage of providing such a decorative necktie knot cover which is easy to place upon and remove from the person's necktie knot, which provides opportunity for the display of jewelry, ornamentation, club insignias and the like, and further is secured about the necktie knot against accidental dislodging until positive steps are taken to remove it, and then when it is to be removed, removal is simple.

SUMMARY OF THE INVENTION

This invention relates to a novel decorative necktie knot cover adapted to encompass a wearer's necktie knot for purposes of jewelry display, ornamentation, or identification. The decorative necktie knot cover comprises means forming a volume or cavity having a triangular cross-section when viewed from the front with the triangular front face adapted to receive the desired ornamentation. The triangular volume is characterized by a pair of oppositely situated openings situated proximate the two angles of the triangle on the top side, and a third opening at the lower angle of the triangle opposite the side containing the two openings. The upper two openings each receive one end of the tie after it has passed around the neck and the lower opening passes out both ends of the tie. Interiorly to the decorative necktie knot cover itself is the necktie knot.

The knot cover is characterized by having two side panels joining the front triangular face, the side panels forming the thickness of the decorative knot cover, with each of the sides then having attached to it a protruding tab. Along the top portion of the decorative necktie knot cover is an attached top panel to which in turn is attached an elongated rear panel, the ends of the top panel forming a portion of each of the two top openings. Obviously the decorative necktie knot cover is of one piece of material, preferably thin flexible metal or plastic. The front face, attached panels, and protruding tabs are defined by fold lines formed in the material.

Further, situated on the elongated rear panel, as well as the protruding tabs from each of the side panels, are a plurality of fasteners, one fastener on one side panel protruding tab adapted to engage one fastener on the rear panel and a second fastener on the opposite side panel protruding tab adapted to engage a second fastener on the rear panel. These form the means to secure the device around the necktie knot.

In use, the side panels attached to the front face are folded around the knot and then the rear panel is placed behind the necktie knot and parallel to the front face by bending along the fold lines defining the top panel. Then, the protruding tab attached to one of the side panels is secured to the rear panel by the fasteners and then the other protruding tab is also secured to the rear panel at their respective fasteners. In one embodiment, snaps are used as fastening means and in a second embodiment VELCRO material is used, one part being the hook type and the other part a loop type.

In another alternate embodiment of the invention, to more completely encompass the necktie knot and to assure rigidity to the invention vis-a-vis resistance to the device collapsing at its center, the rear panel is specially formed also defining a triangle of approximately the same size as the front face and adapted to be aligned immediately behind and parallel to the front face, the rear panel also having a pair of side panels attached along two sides of the triangle. In this embodiment, the sides of the rear panel are bent at a 90 degree angle to the rear panel (as are the side panels to the front face) to securely encompass the necktie knot. Then, protruding tabs attached to each of the front face side panels have fastening means adapted to mate with fastening means situated on the triangularly shaped rear panel.

Further, in another embodiment, the triangular front face has attached on two of its three sides bendable side panels which also have attached to them protruding tabs. The top of the triangular front face has attached to it a top panel to which in turn is attached a triangular shaped rear panel. Along a portion of two of the sides of the triangular shaped rear panel is a second pair of back-side panels. In this embodiment, the back-side panels attached to the triangular shaped rear panel are bent at right angles to the plane of the rear panel and then the device is installed about the necktie of the wearer by bending the top panel along two fold lines to allow the triangular front face and rear panel to encompass the knot. The triangularly shaped rear panel is pushed over the knot by holding the front face and the rear panel such that the rear panel will push aside the protruding tabs until it has bottomed at which time the two protruding tabs attached to the front face side panel overlap the back flat surface of the back panel and hold the rear panel in place.

In all embodiments of the device, the invention is removed by separating the fastening means to permit the rear panel to become uncoupled from the protruding tabs attached to the front face side panels and then as the rear panel moves away from a parallel plane situation with the plane formed by the front face, the decorative necktie knot cover is pulled up and off of the necktie knot.

One last embodiment of the invention provides for the fastening means attached to the protruding tabs to connect with each other over the rear panel rather than attaching to the rear panel itself.

In the embodiments of the invention, various types of materials may be utilized such as flat bendable metal or plastic, or for that matter even cloth material except that in the case of the last two embodiments having triangularly shaped rear panels, a bendable metal or plastic is preferably utilized since a 90 degree right angle relationship between the front face and rear panel with the side panels is preferred.

It is an object of the subject invention to provide a decorative necktie knot cover providing means to encompass the necktie knot with a front face adapted to receive ornamentation or identification.

It is another object of the subject invention to provide a decorative necktie knot cover which is easily emplaced and easily removed, but which provides a positive locking encompassing the necktie knot.

It is still another object of the subject invention to provide a decorative necktie knot cover wherein fastening means assures that the decorative cover is resistive to accidently being pulled off, but when intended to be removed, may be easily manipulated for removal.

Lastly it is still another object of the subject invention to provide a decorative necktie knot cover which encompasses a necktie knot having means to receive the two ends of the necktie surrounding the person's neck and to emit both ends of the necktie from an opposite lower end.

Other objects of the invention will in part be obvious and will in part appear hereinafter. The invention accordingly comprises the apparatus and method comprising construction, combination of elements, and arrangement of parts which are exemplified in the following detailed disclosure and the scope of the application which will be indicated in the claims.

BRIEF DESCRIPTION OF THE DRAWINGS

For further understanding of the nature and objects of the present invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
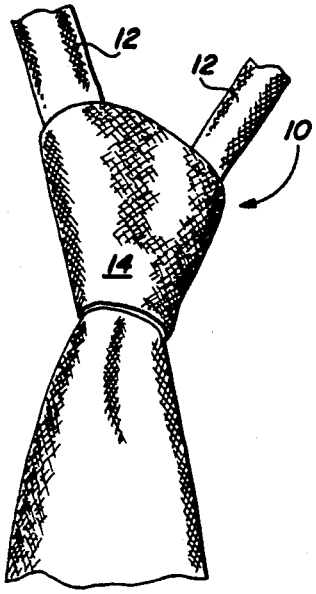
FIG. 1 is a front perspective view of the decorative necktie knot cover together with the necktie hanging around a wearer's neck.

Referring now to FIG. 1, a front elevation view of the subject inventive decorative necktie knot cover is shown as it would be worn on a person situated in the front at the lower neck region. More specifically, decorative necktie knot cover 10 receives both ends of tie 12 (or scarf) as it is wrapped around a person's neck, feeding both ends of tie 12 through two top openings, the necktie knot being immediately below the two openings, and held within a cavity formed immediately behind front face 14. The two ends of the necktie 12 then exit a bottom opening to extend down towards the waist of the wearer. It is obvious that upon the face piece 14 of the decorative necktie cover may be placed ornamentation such as jewelry, logos, or other decorative pieces. These may be attached by an adhesive or with the use of machine screws protruding through openings placed in the face 14 of cover 10, the openings obviously being covered over by the decorative piece.

Figure 2:
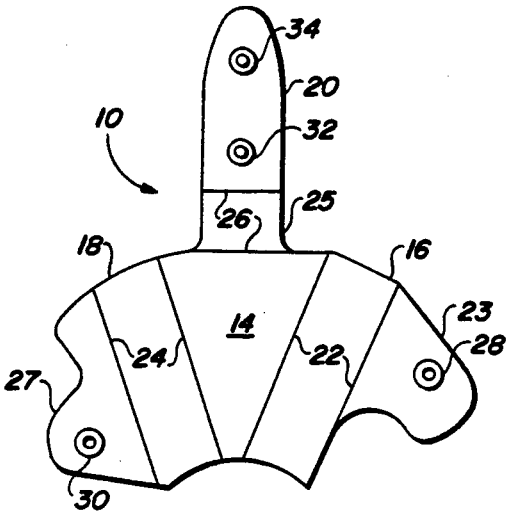
FIG. 2 is a front perspective view of the decorative necktie knot cover opened up and situated in one plane.

The decorative necktie knot cover 10 shown in FIG. 1 may be fabricated by a number of differently shaped, but one piece (initially) thin flat constructions, such as that shown in FIGS. 2–4, and 7. For example, the configuration shown in FIG. 2 is a front view of decorative necktie knot cover 10 opened up and laid in one plane revealing firstly, the centrally located triangularly shaped face piece 14 with attached right side panel 16 and left side panel 18. Attached to right side panel 16 is right protruding tab 23 and to left side panel 18 is left protruding tab 27. Protruding vertically from the top of face 14 is top panel 25 which continues on to elongated finger shaped rear panel piece 20. Seen crossing each of the panels are a series of fold lines, firstly fold lines 22 situated defining panel 16, fold lines 24 defining panel 18 and fold lines 26 defining top panel 25. It is noted that one of each pair of the fold lines defines the triangular front face 14 showing the front face to be, in the preferred embodiment, substantially flat. The side panels are folded on the sides along the fold lines to form the triangular shaped (in cross section) cavity which lies directly under face 14. It is noted that the invention initially before folding lies in one plane.

Also shown in FIG. 2 are the fastening means, i.e., those means by which the decorative necktie knot cover 10 is held in position encapsulating the knot of the necktie worn by the person. More specifically, female snap button 28 resides on right protruding tab 23 near its end and female snap button 30 resides similarly on left protruding tab 27 near its end. Situated in the elongated finger shaped rear panel 20 are the male halves associated with the snap buttons 28 and 30, namely, snap button 32 is the mate for female snap button 28 and male snap button 34 is the mate for female snap button 30.

In operation, the front face 14 of inventive decorative necktie knot cover 10 is placed over the previously formed necktie knot and then firstly top panel 25 is folded around and over the top portion of the necktie knot, utilizing fold lines 26 so that rear panel 20 resides behind the necktie knot and next to the party wearing the necktie. Then, by folding side panel 16 and protruding tab 23 along their fold lines 22, female snap button 28 is in position to engage male snap button 32. This forms then a second side of the decorative necktie knot cover cavity. Lastly, left side panel 18 and protruding tab 27 are folded around the other side of the knot by means of bending each along fold lines 24 in order that female snap button 30 is in position to engage male snap button 34 to hold side panel 18 in place to complete the cavity. The top part of snap buttons 28 and 30, as seen in FIG. 2, lie between the necktie knot and the party wearing the necktie. The cavity thus formed encompasses the necktie knot on five sides, namely the top and the two side panels, and the front and rear panel. The top panel cooperates with the side panels (and front face) to form the two oppositely situated top openings, and the two side panels and the front face to form the bottom opening.

Figure 3:
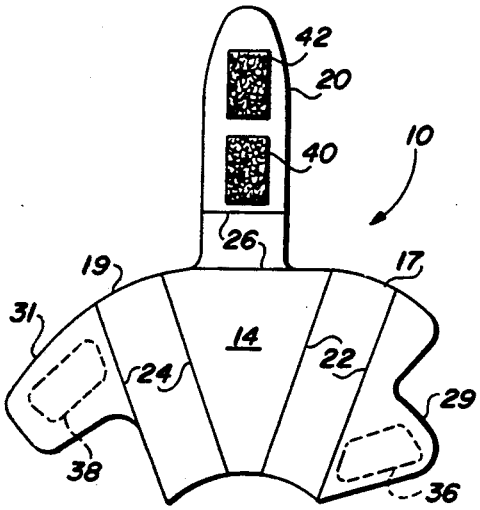
FIG. 3 is a front view of the subject inventive decorative necktie knot cover unfolded in one plane showing an alternate fastening means.

FIG. 3 shows a front view of another embodiment of the subject invention laid out in one plane where modifications have been made in two aspects, namely the right and left protruding tabs 29 and 31 attached to side panels 17 and 19 respectively have the ends of their wing portions located oppositely as was shown in FIG. 2, i.e., the end wing portion of tab 23 was attached to the upper portion of the side panel 16 wherein attached to side panel 17, the end wing portion of tab 29 is greatest in the lower part of the side panel. Similarly, in side panels 18 and 19, the end wing portion of the tabs are also reversed. Secondly, the type of fastener utilized in the embodiment of FIG. 3 is not snap buttons as was utilized in FIG. 2, but VELCRO mating materials were utilized. For example, on elongated finger shaped rear panel piece 20, VELCRO patches 40 and 42 may be the hook-type material and VELCRO patches 36 and 38 the loop-type material. Notice that VELCRO patches 40 and 42 are on the front side of rear panel 20 whereas VELCRO material patches 36 and 38 are on the underside of protruding tabs 29 and 31. Like FIG. 2, the alternate embodiment of FIG. 3 has the same fold lines 22, 24, and 26.

The placement of the decorative necktie knot cover 10 shown in FIG. 3 over the necktie knot requires the same operation described in connection with cover 10 shown in FIG. 2, however in this case, VELCRO pad 36 mates now with VELCRO pad 42, and VELCRO pad 38 mates with VELCRO pad 40, just the opposite as was the case in the snap buttons situated in the preferred embodiment shown in FIG. 2.

Figure 4:
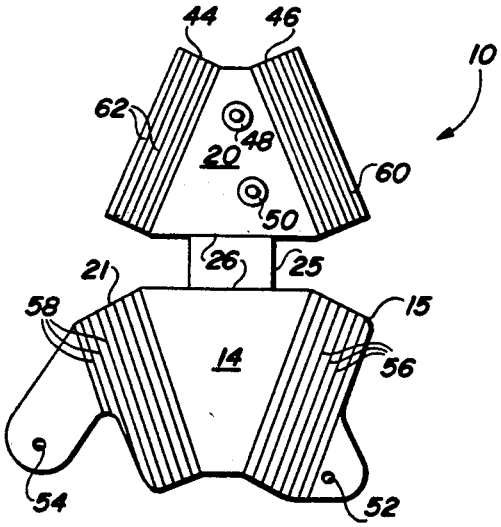
FIG. 4 is a front view of an alternate embodiment of the decorative necktie knot cover unfolded in one plane.

FIG. 4 shows still another embodiment of the decorative necktie knot cover 10 in a laid out flat configuration wherein more variations in the construction of the device have been added. For example, rear panel piece 20 has been reshaped so that it has its own side panels, namely rear left side panel 44 and rear right side panel 46. Further, male type snap buttons 48 and 50 were utilized in rear panel 20 with their centrally located protruding boss pointing upward. Then, into each of the protruding tabs attached to side panels 15 and 21 are formed openings 52 and 54, each of these openings adapted to receive the male protruding boss of snap buttons 48 and 50. In essence, only half of the usual snap buttons were utilized.

Also seen in the embodiment shown in FIG. 4 of the decorative necktie knot cover 10 are a plurality of fold lines in each of the side panels. For example, fold lines 56 are in right side panel 15 as the plurality of fold lines 58 are in the left side panel 21 similarly in the rear panel 20, the plurality of fold lines 60 are in the rear right side panel 46 and the plurality of fold lines 62 in the rear left side panel 44. The purpose for these plurality of fold lines is to allow the sides of the decorative necktie knot cover to take on a rounded configuration rather than the square configuration which results from 90 degree fold line bends in the embodiments shown in FIG. 2.

In forming the cavity which encompasses the necktie knot utilizing the embodiment shown in FIG. 4, it is readily seen by placing face 14 upon the front portion of the necktie knot and then folding over rear panel 20 by means of fold lines 26, and with the rounded interior cavity walls primarily formed by the top left and right side panels 44 and 46 folded along the plurality of fold lines 60 and 62 (which will then be encompassed by side panels 15 and 21 attached to the front face 14), a rounded appearance is taken along two of the three sides of the cavity. The device is held together by the centrally located protruding boss of snap button 48 penetrating opening 52 to be held there and the centrally located protruding boss of snap button 50 protruding through opening 54. Thus, the necktie knot is doubly encapsulated by the embodiment shown in FIG. 4 along two of the triangular sides and the back.

Figure 5:
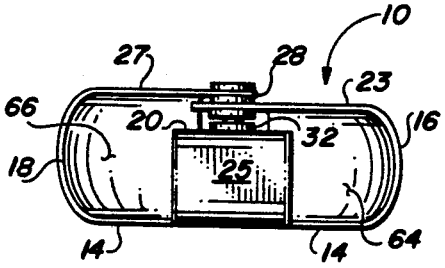
FIG. 5 is a top view of the decorative necktie knot cover showing the top panel and the openings through which two ends of the necktie pass.

Referring now to FIG. 5, a top view of inventive decorative necktie knot cover 10 is shown utilizing the preferred embodiment of FIG. 2. Firstly is shown the front face 14 which in this view is an edge, however the side panels 16 and 18 on either side are illustrated. Top panel 25 is shown centrally to FIG. 5 being bent along its two fold lines and rear panel 20 behind with the centrally located protruding boss emerging from snap button 32 attached to rear panel 20 engaging female snap button 28 attached to the protruding tab 23 attached to side panel 16. Also seen in FIG. 5 is the protruding tab 27 of side panel 18 with its snap button located behind snap button 28. Also seen are the pair of openings on either side of top panel 25, namely right top opening 64 and left top opening 66 through which the ends of the necktie feed into the knot situated interiorly to cover 10. Not shown is the bottom opening.

Figure 6:
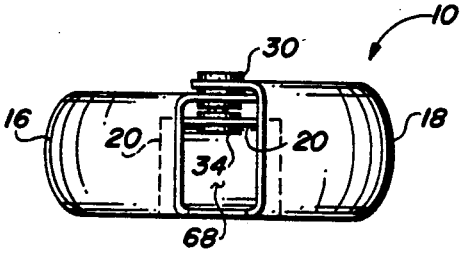
FIG. 6 is a bottom view of the subject decorative necktie knot cover showing the side panels and the bottom opening through which both ends of the necktie pass.

FIG. 6 is a bottom view of decorative necktie knot cover 10 showing firstly the central bottom opening 68 through which feeds the two ends of the necktie after emerging from their knot. On either side of bottom opening 16 are the side panels 16 and 18 (here reversed from that shown in FIG. 5) as well as the end of rear panel 20 with its snap button 34 there attached. The centrally located protruding male boss of snap button 34 is shown connecting with female snap button 30 attached to the protruding tab 27 of the left side panel 18.

Figure 7:
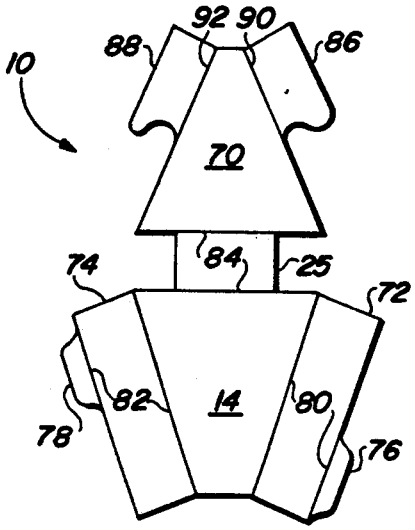
FIG. 7 is a front view of still another alternate embodiment of the decorative necktie knot cover unfolded in one plane.

Referring now to FIG. 7, another alternate embodiment of a decorative necktie knot cover 10 is shown in a planar front view. As is seen, this embodiment does not employ the fastening means shown in all other embodiments but rather employs other means to secure the rear panel piece 70 in place. More specifically, the alternate embodiment shown in FIG. 7 still contains the front face 14 as do all embodiments to which decoration may be attached as desired and similarly to all other models, has the right and left side panels 72 and 74. However, to these panels are attached protruding tabs 76 and 78 respectively. Also shown and connecting with face 14 are the fold lines 80 and 82, fold lines indicating where, in the fold lines defining face 14, the 90 degree angle bend is made, and the fold lines also defining the outstanding tabs 76 and 78 by again a 90 degree bend. Moving upward, fold lines 84 illustrate how rear panel 70 is folded around through two 90 degree folds (at fold lines 84) on opposite sides of top panel 25 in order that rear panel 70 should be parallel to and behind front face 14. Attached to rear panel 70 is a pair of panels, namely right side panel 86 and left side panel 88. Demarking the right and left side panels are fold lines 90 and 92 which define the line upon which the right side panel and the left side panel are folded at 90 degrees to the plane of the rear panel 70.

The embodiment of the invention described in FIG. 7 is used similarly as are all the embodiments of the invention, namely, firstly the right and left side panels 72 and 74 are bent at a 90 degree angle to the plane of front face 14 and then the left and right protruding tabs 76 and 78 respectively are again bent along fold lines 80 and 82 to be at a right angle to the side panels. Protruding tabs thus 76 and 78 provide a catch means for the rear panel 70 when it resides parallel to and behind front face 14. Next, the right and left side panels 86 and 88 to rear panel 70 are bent at a 90 degree angle along fold lines 90 and 92 respectively to the plane of rear panel 70. Lastly, rear panel 70 is oriented parallel and behind front face 14 by each of the fold lines 84 being bent also at a 90 degree angle.

In operation, the decorative necktie knot cover 10 shown in FIG. 7 is then placed around the necktie knot as previously described and then the rear panel 70 is bent around to a position where it is behind and parallel to front face 14. The sides of rear panel 70 engage the edges of right and left protruding tabs 76 and 78 pushing them outward in order that rear panel 70 may come in position behind front face 14. As soon as rear panel 70 is in position, its top face will be encompassed by outstanding tabs 76 and 78 and thus be held in place. To remove knot cover 10 all one need do is to reach behind the cover, placing a fingernail under the bottom edge of the rear panel 70 (which appears as the top edge of rear panel 70 in FIG. 7), and pull away from face 14. The thin sheet metal or plastic utilized in the device has sufficient give to it to permit protruding tabs 76 and 78 to move back out of the way and permit the disengagement of rear panel 70 from its position in order that the decorative cover may be removed from around the necktie knot.

Figure 8:
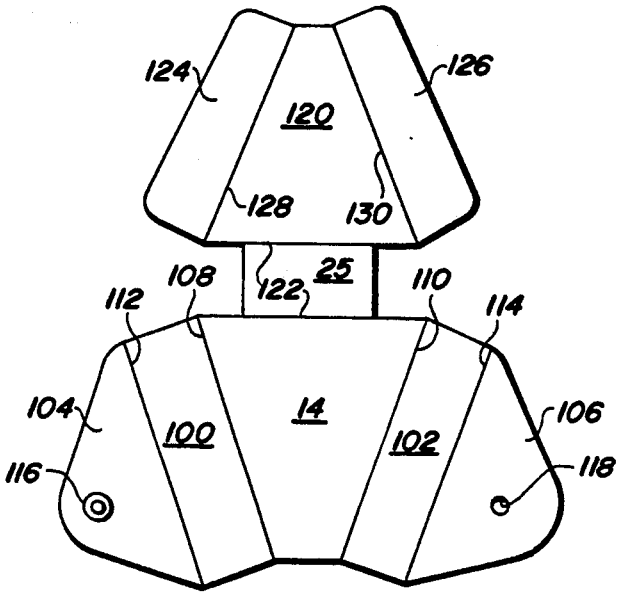
FIG. 8 is a front view of still a further alternate embodiment of the decorative necktie knot cover unfolded in one plane showing an alternate fastening method.

FIG. 8 is still a further embodiment of the subject decorative necktie knot cover wherein the means of securing or fastening the invention to form the plenum which surrounds the necktie knot have been changed from the left and right protruding tabs attached to the rear panel to the right and left protruding tabs where they now attach to themselves over or immediately behind the rear panel piece. More specifically, the alternate embodiment of the invention shown in FIG. 8 comprises a majority of similar elements as does the preferred embodiment and the alternate embodiments previously shown and described, consisting firstly of substantially triangular front face 14, which is the portion immediately visible to an observer of the party wearing the decorative necktie knot cover. Attached on opposite sides of front face 14 are generally rectangular left side panel 100 and right side panel 102. Connecting to the left and right panels 100 and 102 is generally triangular left protruding tab 104 and right protruding tab 106 respectively. As was the case in the previous embodiments, the left and right side panels are defined by fold lines, fold line 108 separating face piece 14 from left panel 100 and fold line 110 separating face piece 14 from right panel 102. Similarly, fold line 112 defines and separates left panel 100 from left protruding tab 104 as fold line 114 defines and separates right panel 102 from right protruding tab 106. These fold lines in the assembled decorative necktie knot cover define the relationship of adjoining pieces at right angles.

Noted is the subject improvement attached near the apex of triangularly shaped left protruding tab 104, namely female attachment or fastening element 116 which in the embodiment was the female portion of a snap button assembly. Then, complementing the female fastening element 116 is the male attachment or fastening element 118 situated near the apex of triangularly shaped right protruding tab 106 which, in the embodiment shown, comprises the male portion of a snap button assembly. It is realized that many methods of attachment of fastening mechanisms may be utilized for fastening elements 116 and 118, and as an example, the inventor has utilized for these élements, as described in the foregoing description of embodiments of the invention, VELCRO materials. Additionally, it has been determined in constructing the invention of thin sheets of resilient plastic, the device may be vacuum formed with the male and female fastening elements formed in the plastic wherein an opening is utilized for the female element and a protruding boss, completely formed from plastic, for the male element.

Continuing with the description of FIG. 8, attached to the top portion of front face 14 is generally rectangular top panel 25, defined and separated from face 14 and rear panel 120 by fold lines 122. As was the case in the prior embodiments, rear panel 120 comprises a substantially triangular piece to which have been attached at fold lines 130, generally rectangular left rear side panel 124 and right rear side panel 126. The left rear side panel is separated and defined by fold line 128 connecting it to rear panel piece 120 as right rear side panel 126 is connected to and defined by fold line 130 connecting it with rear panel piece 120.

In assembly of the embodiment shown in FIG. 8, the same procedure is utilized as with the other embodiments, namely that once the party wearing the necktie is ready to cover the necktie, the left and right rear side panels are folded at a right angle with respect to the rear panel and then the rear panel is placed behind the necktie. The left and right rear side panels then will encompass the sides of the necktie knot. The top panel is folded over the top of the necktie knot at right angles to bring down face 14 covering the front portion of the necktie knot. Then, the left and right panels 100 and 102 are folded around the sides of the necktie knot which in this case, means around the left and right rear side panels 124 and 126. Next, the left and right protruding tabs 104 and 106 attached to the left and right panel 100 and 102 respectively are folded back over the rear panel piece and over each other. The two fastening elements 116 and 118 are then brought together and secured to each other and the invention held in place operating as the decorative necktie knot cover.

Figure 9A:
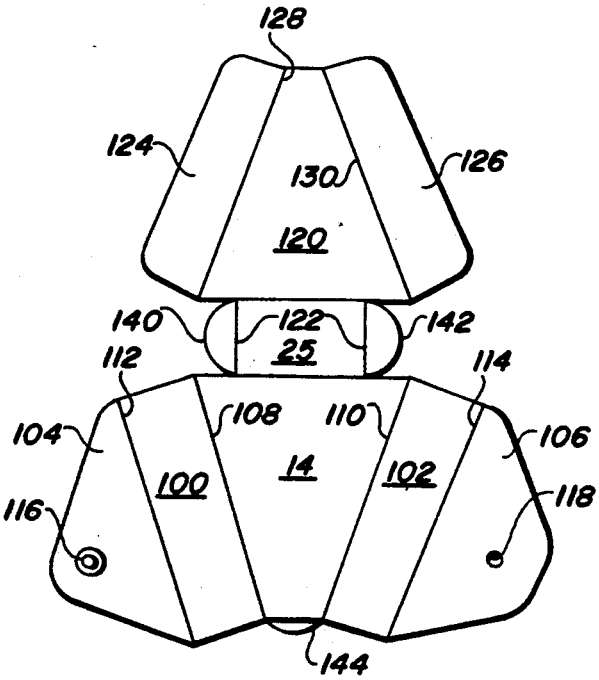
FIGS. 9.*a*. and 9.*b*. show the embodiment of FIG. 8 wherein holding tabs have been added for the purpose of securing a thin sheet of decorative material behind a transparent necktie knot cover and FIG. 9.*b*. is a top view of the thin sheet of decorative material which is secured by the holding tabs set out in FIG. 9.*a*.
Figure 9B:
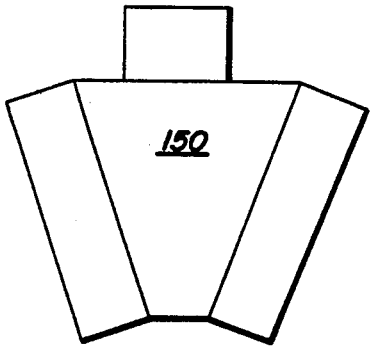

FIG. 9.*a*. shows a modification of the alternate embodiment of FIG. 8 with the addition of half-moon shaped tabs 140, 142, and 144. In the construction of the invention, thin resilient transparent plastic was utilized. By the use of such material, it is possible to place decoration underneath the decorative necktie knot cover. The half-moon shaped holding tabs shown in FIG. 9.*a*. permit the installation of decoration inside the necktie knot cover. For example, FIG. 9.*b*. illustrates decorative insert 150, which may be made of colored paper, for example, with a desired insignia or other decoration on it. Decorative insert 150 then is adapted to be placed so that it underlies face 14, top panel 25, and left and right panels 100 and 102 of the embodiment shown in FIG. 9.*a*. Then, first half-moon shaped holding tabs 140, second tab 142, and third tab 144 are folded over to hold decorative insert 150 in place and secure it there. Obviously, the dimensions of decorative insert 150 are the same as the portions of the necktie knot cover which it underlies shown in FIG. 9.*a*. or, just perhaps, a slight bit smaller in dimensions.

In the preferred embodiment, the subject decorative necktie knot cover was constructed of thin sheet plastic, the plastic being sufficiently durable to bend only along the bend lines which had been forcibly formed in the plastic. It is realized that the invention may also be constructed of cardboard, thin metal, and even for that matter, cloth material although rigidity and flat sidedness of such things as front face 14 would most likely not remain if the construction is cloth material. As indicated earlier, the decorative cover may be coated or colored or decorated with selected materials such as jewels, advertising slogans, company logos, and the like.

It is also readily apparent that with the subject invention, if the top and bottom openings are constructed so as to constrict the necktie or scarf running through these openings, it may not be necessary even to have a knot interiorly to the decorative cover, but in fact the decorative cover may perform the function of the knot of keeping the necktie around the neck.

Still further, while a triangular-shaped front face has been shown in the preferred embodiment, it is readily apparent that the front face could take the appearance of a circle, or rectangle wherein ordinary engineering skill is then employed to construct the side panels, the protruding tabs, and the rear panels so that they still perform the same function of wrapping around the rear from the front face to join each other encapsulating a necktie knot while providing at least one opening at the top and one opening at the bottom, it being readily apparent that both ends of the necktie could enter the inventive knot cover through a single opening as well as exiting the knot cover through a single opening.

It is realized that hinges may be substituted for the fold lines indicated and in such case, the inventive decorative necktie knot cover may be constructed from cast or other rigid metals and materials. In addition, while snap buttons and VELCRO has been mentioned as the means to fasten the protruding tabs to the back panel, there are other fastening means that may be utilized.

While a preferred embodiment of the invention has been shown and described, together with alternate embodiments, it will be appreciated that there is no intent to limit the invention by such disclosure. Rather, the disclosure is intended to cover all modifications and alternate embodiments falling within the spirit and the scope of the invention as defined in the appended claims.

I claim:

1. A decorative cover for the knot of a necktie being worn by a person comprising:

a front face adapted to receive decoration;

at least one side panel operably attached to said front face;

a top panel operably attached to said front face;

a rear panel spaced apart and parallel to said front face, said rear panel operably attached to said top panel, said front face, side panel, top panel, and rear panel each contributing to form the walls of a cavity to encompass the knot, said front face, side panel, top panel, and rear panel also contributing to form a plurality of openings between the panels into the cavity to allow entrance of the tie into the cavity and its exit therefrom;

a protruding tab operably attached to said side panel, said protruding tab also defining in part the cavity encompassing the knot; and fastening means securing said protruding tab to said back panel to secure and define the cavity encompassing the necktie knot whereby the decorative cover is secured about the necktie knot against inadvertent removal.

2. The decorative cover as defined in claim 1 further including a second side panel attached to said front face, each said first and second side panel having a protruding tab operably attached thereto, each said protruding tab operably secured to said rear panel.

3. The decorative cover as defined in claim 2 wherein each said first and second side panel and said top panel is folded at an angle to said front face, and each said protruding tab folded at an angle to each said first and second side panel.

4. The decorative cover as defined in claim 3 wherein each said first and second side panel and said top panel is folded at a 90 degree angle to said front face, and each said protruding tab folded at a 90 degree angle to each said first and second side panel, each said protruding tab over-lapping to secure said rear panel.

5. The decorative cover as defined in claim 3 wherein said fastening means comprises snap buttons, said snap buttons having a female part and male part, one said female part attached to each said protruding tab and one said male part attached to said rear panel, said male part and female part forced together to secure each said protruding tab to said rear panel.

6. The decorative cover as defined in claim 5 wherein said fastening means includes VELCRO fasteners of hook and loop type, said hook type attached to each said protruding tab and said loop type attached to said rear panel whereby each said hook type and loop type are brought together to secure each said protruding tab to said rear panel.

7. The decorative cover as defined in claim 3 wherein said front face defines a three-sided triangular shaped face, said first and second side panel and top panel each attached to one of each side of said three-sided triangular shaped front face.

8. The decorative cover as defined in claim 7 wherein said rear panel defines an elongated finger shaped panel.

9. The decorative cover as defined in claim 7 wherein said rear panel defines a three-sided triangularly shaped panel, and further including a first and second rear-side panel operably attached to two sides of said three-sided triangularly shaped rear panel, each said first and second rear-side panel adapted to be folded at an angle to said rear panel, said first rear-side panel and second rear-side panel defining in part the cavity encompassing the necktie knot.

10. The decorative cover as defined in claim 7 wherein each said first and second side panel and said top panel is folded at a 90 degree angle to said front face, and each said protruding tab folded at a 90 degree angle to each said side panel, each said protruding tab over-lapping said rear panel.

11. The decorative cover as defined in claim 7 wherein said front face is planar and adapted to receive decoration.

12. The decorative cover as defined in claim 3 wherein said cover comprises a single thin sheet of durabel material folded to form said front face, first and second panel side panel, top panel, and rear panel.

13. The decorative cover as defined in claim 12 wherein said single thin material comprises plastic.

14. The decorative cover as defined in claim 12 wherein said single thin material comprises metal.

15. A decorative cover for the knot of a necktie being worn by a person comprising:

a front face adapted to receive decoration;

a first and second side panel, each operably attached to said front face;

a top panel operably attached to said front face;

a rear panel spaced apart and parallel to said front face, said rear panel operably attached to said top panel;

a first rear-side panel and a second rear-side panel, each operably attached to said rear-panel, said front face, first and second side panel, top panel, rear panel, and said first and second rear-side panel each contributing to form the walls of a cavity to encompass the knot, said front face, first and second side panel, top panel, rear panel, and said first and second rear-side panel also contributing to form a plurality of openings between the panels into the cavity to allow entrance of the tie into the cavity and its exit therefrom;

a first protruding tab and a second protruding tab, said first protruding tab operably attached to said first side panel and said second protruding tab operably attached to said second side panel; and fastening means securing said first protruding tab to said second protruding tab to secure and define the cavity encompassing the necktie knot whereby the decorative cover is secured about the necktie knot against inadvertent removal.

16. The decorative cover as defined in claim 15 wherein said fastening means comprises a female fastening element and a male fastening element, said female fastening element operably attached to said first protruding tab and said male fastening element operably attached to said second protruding tab.

17. The decorative necktie as defined in claim 16 further including a first, second, and third holding tab, said first and second holding tab operably attached to said top panel, and said third holding tab operably attached to said front face.

18. The decorative cover as defined in claim 17 further including a decorative insert adapted to be placed interiorly to the cavity formed in said decorative necktie cover, said decorative insert secured in the cavity by said first, second, and third holding tabs.

* * * * *